US006722643B1

(12) United States Patent
Kurtz

(10) Patent No.: US 6,722,643 B1
(45) Date of Patent: Apr. 20, 2004

(54) MULTI-CLAMP

(76) Inventor: William C. Kurtz, 2187 State Rd. 87, St. Croix Falls, WI (US) 54024-7851

( * ) Notice: Subject to any disclaimer, the term of this patent is extended or adjusted under 35 U.S.C. 154(b) by 0 days.

(21) Appl. No.: 10/444,740

(22) Filed: May 23, 2003

Related U.S. Application Data

(60) Provisional application No. 60/383,475, filed on May 23, 2002.

(51) Int. Cl.[7] ..... B25B 5/10

(52) U.S. Cl. ..... 269/249; 269/6; 269/3; 269/95

(58) Field of Search ..... 269/249, 6, 3, 269/57, 95, 97, 143, 246

(56) References Cited

U.S. PATENT DOCUMENTS

| | | | | | |
|---|---|---|---|---|---|
| 287,271 | A | | 10/1883 | Gladwin | |
| 777,611 | A | | 12/1904 | Dodge | |
| 800,685 | A | | 10/1905 | Scoggins | |
| 1,201,888 | A | | 10/1916 | Steuber | |
| 1,987,826 | A | * | 1/1935 | Huemann | 403/73 |
| 2,282,310 | A | | 5/1942 | Dunn | |
| 2,773,303 | A | | 12/1956 | Tirone | |
| 2,816,586 | A | | 12/1957 | Koberle | |
| 2,991,669 | A | | 7/1961 | Stock | |
| 3,033,559 | A | | 5/1962 | Lindholm | |
| 3,061,302 | A | | 10/1962 | Dennis | |
| 3,499,206 | A | | 3/1970 | Quernheim | |
| 3,933,346 | A | | 1/1976 | Carver | |
| 4,257,584 | A | | 3/1981 | Sterling | |
| 4,306,710 | A | | 12/1981 | Vosper | |
| 4,339,113 | A | | 7/1982 | Vosper | |
| 5,009,134 | A | | 4/1991 | Sorensen et al. | |
| 5,022,636 | A | | 6/1991 | Swann | |
| 5,074,012 | A | * | 12/1991 | Mitchell | 24/569 |
| 5,090,670 | A | * | 2/1992 | Yang | 269/249 |
| 5,094,436 | A | | 3/1992 | Stephan, III | |
| 5,286,211 | A | * | 2/1994 | McIntosh | 439/100 |
| 5,460,351 | A | * | 10/1995 | Holloway | 251/214 |
| 5,593,147 | A | | 1/1997 | Read | |
| 6,022,008 | A | * | 2/2000 | Bachman | 269/37 |
| 6,036,184 | A | | 3/2000 | Wurthele | |
| 2003/0025262 | A1 | * | 2/2003 | Kranzler | 269/249 |

OTHER PUBLICATIONS

7 Corners Hardware Catalog, 2003, pp. 368 & 377.
Grizzly Industrial Woodworking & Metalworking Catalog, 2003, pp. 76, 243 & 248.

* cited by examiner

*Primary Examiner*—Lee D. Wilson
(74) *Attorney, Agent, or Firm*—Albert W. Watkins

(57) ABSTRACT

A multi-clamp is illustrated which operates in the manner of a traditional "c"-clamp, but which also operates cooperatively with a support such as a pipe or bar clamp to apply forces normal to otherwise difficult or impossible to reach large sheet materials. A pair of nested u-shaped members are coupled together with a threaded rod. A knob is used to actuate the threaded rod and provide motive force or actuation between the nested u-shaped members. Two alternative embodiments are also illustrated.

16 Claims, 5 Drawing Sheets

MULTI-CLAMP

CROSS REFERENCE TO RELATED APPLICATIONS

This application claims priority to U.S. provisional patent application No. 60/383,475 filed May 23, 2002 and co-pending herewith, the contents which are incorporated herein by reference in entirety.

BACKGROUND OF THE INVENTION

1. Field of the Invention

The present invention pertains generally to work holders, and more specifically to a work holder having one jaw that is common to plural coacting jaws. In a yet more specific manifestation of the invention, a clamp has a plurality of jaws that interact with at least one additional clamp or fixture to apply forces to a work surface at locations that would otherwise be impractical or impossible to reach.

2. Description of the Related Art

Mankind has, throughout the ages, used available materials in the construction of both essential and non-essential items. This construction has been so refined through the ages that many persons today depend for their entire existence upon these constructed articles. Mankind is, however, quite unique in the animal kingdom in this ability to construct so many different commodities.

In the manufacture or production of commodities, people use many diverse tools to simplify and enable the required processes or events to occur. Since a person is only provided with limited appendages, and these appendages can generally be applied to more useful and valuable purposes, a common need is that of ways to hold an object in place without requiring an extended application of manual force. Frequently, the object being held will be a stock material that is being acted upon in some way, such a machining, drilling, sanding, adhesively or metallurgically bonding, or any of a nearly limitless other assortment of processes and operations, as has been illustrated in the prior art and will be understood to be included herein. Objects that are relatively of the same size or smaller than a clamp or vise are frequently retained by one or more of these clamps with relative ease and simplicity. This is because the jaws of the clamp are generally within a few multiples of size of the object, and the jaws will then be capable of reaching to and apply forces at a sufficient number of points or locations on the object to achieve the desired or required application of force.

Unfortunately, when the object or work becomes relatively larger, the cost of purchasing and storing proportionally larger clamps frequently becomes prohibitive. Instead of trying to purchase and store such giant and bulky clamps, a person will instead rely upon more universal clamps and jigs. When these clamps and jigs are unable to apply a desired or essential force, a person will then be forced to forego the particular application, sometimes forcing full redesign of project and plans.

Common types of clamps include c-clamps, which are so named since the fixed jaw is formed into the general shape of the letter "C", pipe clamps which provide jaws at indeterminate locations along an indeterminate length pipe, and bar clamps, which may be of indeterminate length but which more commonly are between pipe and c-clamps in length. These most common commercially available clamps each have only a few inches of jaw length transverse to the clamping axis, and are consequently able to grab a very limited distance onto an object. Because the length of the bar and c-clamps may be indeterminate, the spacing between jaws may be substantially larger, spanning several feet or more. This ability to adjust the jaw spacing has permitted many smaller enthusiasts or workers to keep on hand such clamps and address many of the requirements for applying force that are encountered within a work shop, irrespective of whether the shop is used for wood, metal, plastic or other stock materials or compositions.

Nevertheless, there has continued to be a particularly vexing problem that is all too frequently encountered. When a large sheet of stock material is to be worked upon and requires application of forces normal to the surface of the sheet, such forces may only be attained readily at points immediately adjacent to the edges of the sheets. This is because those foregoing clamps have short jaw lengths transverse to the force axis. While it is possible to increase the jaw size, this adds substantially to the weight and cost, and limits the application of the clamp to progressively larger objects. Between weight, cost and applicability to only larger work objects, the flexibility that was the benefit of these types of clamps is completely lost.

In order to provide access along the interior of larger planar surfaces, several clamps are available that are configured to cooperatively engage with bar clamps, and then apply forces transverse to the longitudinal bar axis. Such clamps are available, for exemplary purposes, from Bessey and referred to as edge clamps. Other clamps sold under the Bessey name include "Pony" veneer press screws, which wrap about a pipe and apply forces transverse thereto. Yet another type of veneer clamp is referenced as the "Jorgensen" press screw. The teachings of each of these clamps are hereby incorporated herein by reference. However, as is known to those in the art, these clamps are specialty clamps having very specific utility. For example, the "Pony" veneer press screws sold by Bessey are applicable only to particular diameters of black pipe, and are incompatible with other types of supports. Similarly, the "Jorgensen" press screws require a hole in a support through which the screw may pass and be anchored to. Consequently, there is not an opportunity for unlimited adjustment, nor for alternative or diverse application with either of these commercially available clamping devices. Their application and adjustment range are both undesirably limited.

A number of patents also illustrate exemplary clamps, similar to the Bessey clamps referred to herein above. The contents of each of these are incorporated herein by reference for the teachings that are found therein. These patents include U.S. Pat. No. 2,773,303, to Tirone; U.S. Pat. No. 2,991,669 to Stock; U.S. Pat. No. 2,816,586 to Koberle; and U.S. Pat. No. 1,201,888 to Steuber. These patents also suffer from the above described drawbacks.

SUMMARY OF THE INVENTION

In a first manifestation, the invention is a clamp having only three jaws, each with a work engaging surface, and an actuator. The second jaw work engaging surface faces the first jaw. The third jaw, which is substantially fixed in location relative to the second jaw, has a work engaging surface generally opposed to the& first jaw work engaging surface. The actuator is coupled to and actuates the first jaw along a travel path.

In a second manifestation, the invention is a combination stand, carrier mounted upon the stand and clamp assembly slidably supported upon the carrier. Means are provided to hold the carrier in a desired position relative to the stand.

The clamp assembly consists of only three jaws and a locking mechanism. A first one of the three jaws attaches to an actuating assembly that can be driven with force along a linear path. A work engaging surface faces generally in a first direction along that linear path. A second one of the three jaws attaches at a substantially fixed location along the linear path and has a work engaging surface facing generally opposed to the first jaw work engaging surface. The third jaw attaches at a second substantially fixed location along the linear path and is separated from the second jaw location by the first jaw. The third jaw also has a work engaging surface facing generally opposed to the first jaw work engaging surface. A means is provided for preventing relative motion between clamp and surface of the carrier.

In a third manifestation, the invention is a workpiece and associated support. The workpiece has a first major surface that is spanned by the support. A clamp has a first channel and a second channel nested in and movable relative to the first channel. The clamp second channel rigidly engages the support and the clamp first channel rigidly engages the workpiece.

In a fourth manifestation, the invention is a clamp. According to this manifestation, the clamp has a first u-shaped strap having a coupling and at least one jaw work engaging surface thereon. A second u-shaped strap is nested within the first u-shaped strap and has a coupling and at least one jaw work engaging surface. A means is provided for moving the first u-shaped strap relative to the second u-shaped strap.

OBJECTS OF THE INVENTION

Exemplary embodiments of the present invention solve inadequacies of the prior art by providing a plurality of jaws, including in a preferred embodiment at least one jaw nested within an exterior pair of jaws, for alternatively applying a separating force or a compressive force. A preferred configuration is illustrated which readily accommodates a wide variety of available supports that may be used for engagement, in combination with the present invention, to achieve anchoring in previously inaccessible or uneconomical locations.

A first object of the invention is to provide a small and easy to handle clamping attachment that may be used with existing common clamping structures to apply forces normal to and anywhere across a large planar surface. A second object of the invention is to provide this clamp for relatively low cost by avoiding the use or incorporation of difficult-to-manufacture parts. Another object of the present invention is to enable this clamp to be used either as a means for applying normal forces, or, alternatively, as a standard c-clamp. Such alternative use reduces required storage space and reduces the cost per use of the present clamp. A further object of the invention is to fabricate such a clamp that with only a minor additional component may be used for either wood contact or for metal welding exposure. Yet another object of the invention is the reduction of clearance required between a support and work piece within which the clamp may be effective. Yet a further object of the invention is the flexibility of not only clamping across major surfaces spanned by supports, but also being able to cooperatively apply edge forces or other forces transverse to a clamp, and in association with such diverse clamp types as bar, pipe, "c", band and other clamps known in the prior art or even in association with the present clamp.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Manifested in the preferred and alternative embodiments, the present invention provides in a single clamp the capability of applying a compressive force between two jaws directed along a single axis, as found in a prior art c-clamp. The present invention simultaneously provides in this same single clamp the ability to apply normal forces to a large sheet or planar work surface or even an edge surface through interaction with fixtures or other clamping devices, such as is found in the various veneer and edge clamps incorporated herein above by reference.

For the purposes of this disclosure, a jaw is herein defined as a clamp surface that applies force to a workpiece and the immediate mechanical structure upon which that surface is formed. The work engaging surface of a jaw may be planar, curved, angled, sharp, patterned, or textured. Two jaws may be constructed upon one support structure, and can be distinguished by a region of non-contact and a reaction force vector of different direction with a workpiece. A work engaging surface of a jaw is defined as that portion of the jaw that is configured to operatively contact a workpiece. There may be one or a plurality of points of contact between a work engaging surface and a workpiece. The forces applied to hold or position the workpiece may be either compressive in the case of an outside clamp, or expansive in the case of an inside clamp.

Figure 1:
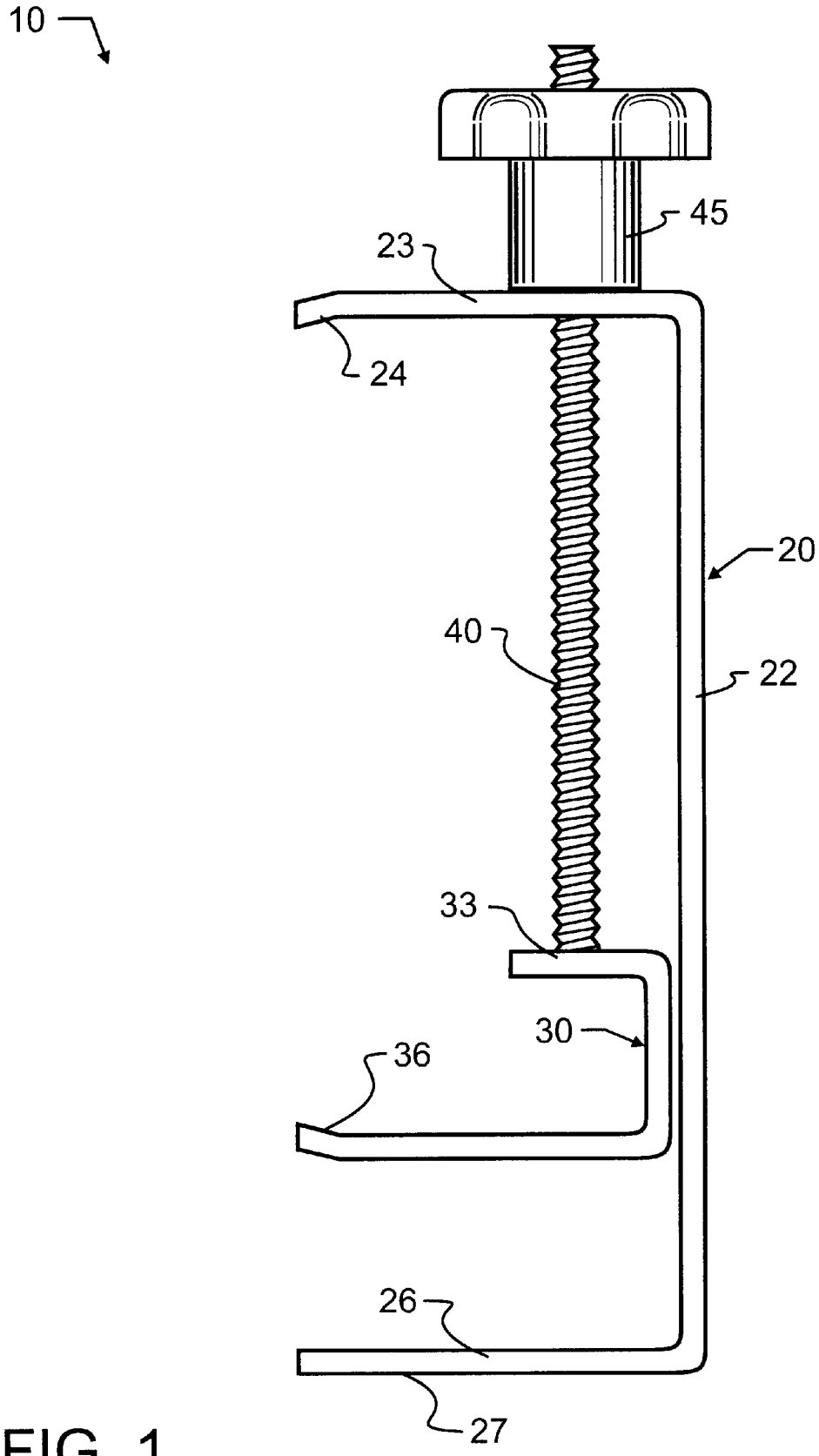
FIG. 1 illustrates a preferred embodiment multi-clamp designed in accord with the teachings of the present invention from a side plan view.
Figure 2:
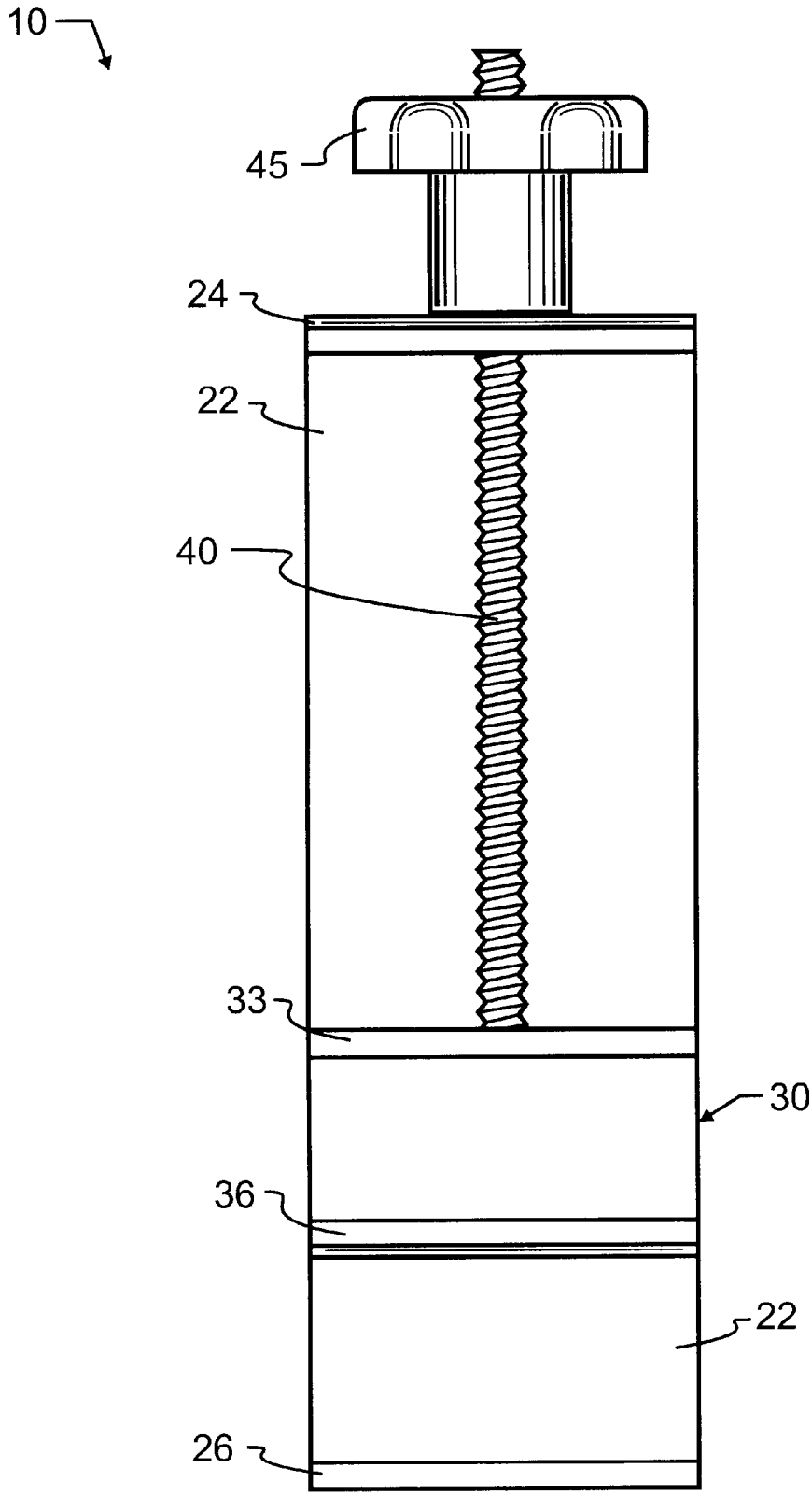
FIG. 2 illustrates the preferred embodiment multi-clamp of FIG. 1 from a top plan view.
Figure 3:
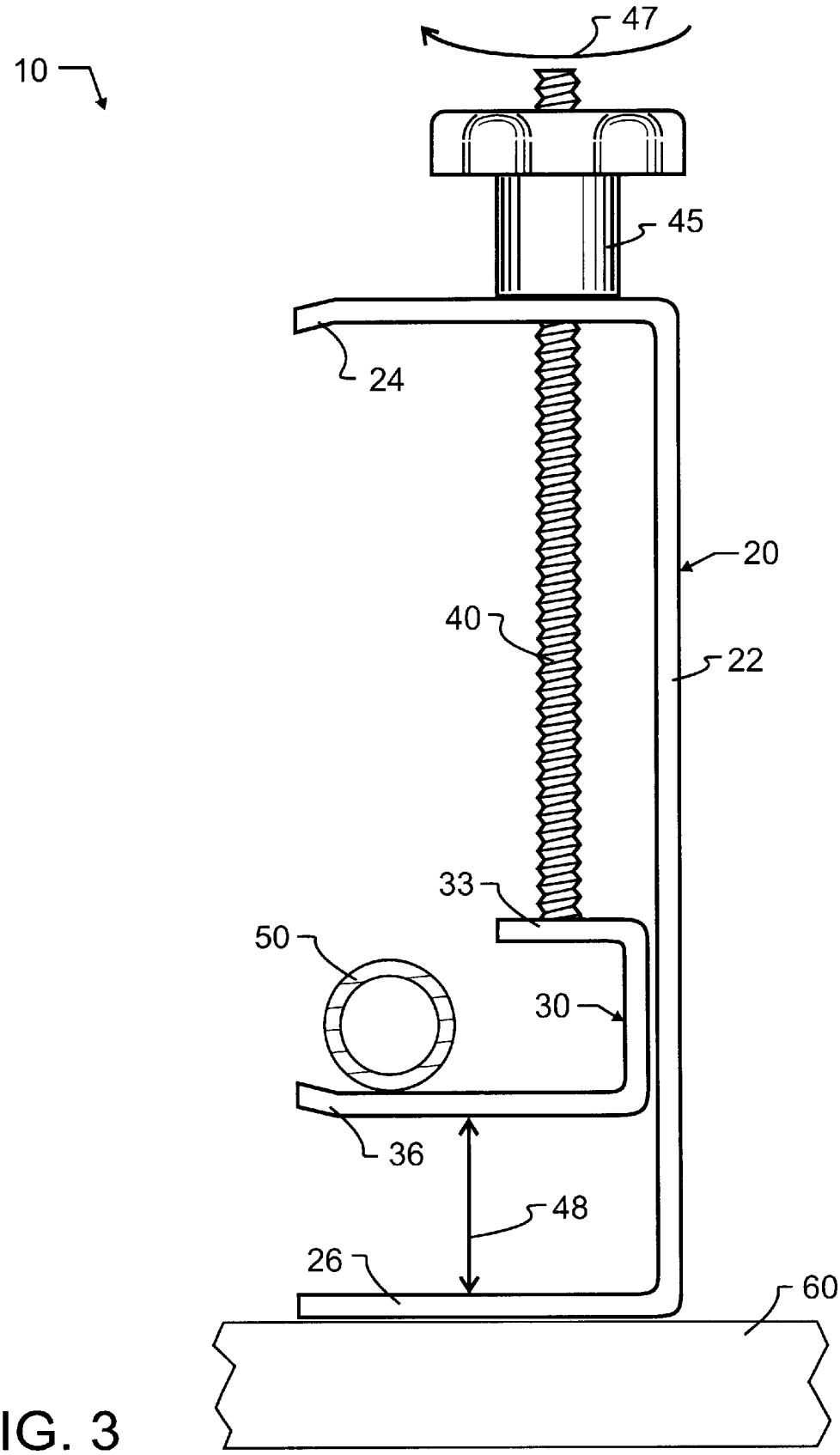
FIG. 3 illustrates the preferred embodiment multi-clamp of FIG. 1 in further preferred combination with a fixture and a work surface.

In accord with preferred embodiment multi-clamp 10 illustrated in FIGS. 1–3, two generally u-shaped members 20, 30 are nested together for relative movement there between. In preferred embodiment 10, these u-shaped members 20, 30 do not need any rigid interconnection, and instead are free to move relative to one another, only limited by the movement permitted by the combination of knob 45, threaded rod 40 and the opening in arm 23 through which threaded rod 40 passes.

Materials are not critical to the performance of the present invention, and these components are contemplated to be manufactured from any suitable material that is able to provide adequate strength to generate and withstand anticipated clamping forces. Nevertheless, in the most preferred embodiment multi-clamp 10, u-shaped members 20,30 are fabricated from cold rolled steel and then subsequently zinc plated. The particular use of steel permits unshaped members 20, 30 to be fabricated in a very high volume, relatively low-cost punching operation from readily available steel. The resultant product has substantial strength, durability and corrosion resistance. Where desired, the u-shaped members 20, 30 may be fabricated from other processes or have other coatings applied thereto as are known in the art of metal fabrication. Common coatings such as powder coatings, various paints and lacquers, and dip coatings such as from vinyl are all contemplated herein, as are the myriad of other known materials and methods.

While dimensions are similarly not critical to the performance of the invention, from FIG. 2 in preferred embodiment multi-clamp 10 it is evident that u-shaped members 20, 30 are fabricated from steel having the same width. This is preferred since then fabrication of both members 20 and 30 from the same stock is possible, in turn increasing the volume of a single size used and lowering the total overall cost. Nevertheless, this is not essential and different sizes, thicknesses and even compositions of stock material may be used in the fabrication of these two members.

As is best evident in FIG. 1, one or more of the jaws may be curved, to help prevent a workpiece from slipping out of multi-clamp 10 when clamping forces are applied. This is illustrated by jaws 24 and 36, which are both angled somewhat relative to the surrounding metal from u-shaped members 20, 30. In an alternative, the entire arm extending normal to threaded rod 40 may be angled acutely with respect to the anticipated force. In such a case, any deformation would still keep the angle of contact with a square work piece at an angle adequate to pull the workpiece into multi-clamp 10 rather than push the workpiece out of engagement. As aforementioned, special coatings may be applied, or sleeves slipped around work surfaces or jaws, as desired. The use of such sleeves will permit a zinc plated clamp that would be suitable for metal work to be adapted to wood use through the provision of a polymer sleeve.

Operation of multi-clamp 10 will be best understood from FIG. 3, which illustrates preferred multi-clamp 10 in combination with a pipe 50 and work surface 60. In the most preferred combination, and recognizing that the invention is not solely limited thereto but instead acquires additional significance therewith, work surface 60 is a large, planar surface, such as may be associated with sheets of lumber, particle board, chip board, plywood, laminates, and so forth. As aforementioned, the application of forces normal to the major surface of work surface 60, which is the large planar surface in contact with jaw 26 in FIG. 3, is very difficult or impossible using prior art techniques. However, preferred multi-clamp 10 enables application of such force through a very simple and rapid process. In accord with the invention, internal u-shaped member 30, which is in the general shape of a channel, is slipped about pipe 50. It should be apparent that the shape of pipe 50 is not critical, so long as there is sufficient clearance to allow pipe 50 to be supported in contact with u-shaped member 30. If not already positioned so, knob 45 may be rotated counterclockwise, or opposite to arrow 47, to decrease the distance illustrated in FIG. 3 as gap 48. This will allow jaw 36 to pass under pipe 50 and jaw 26 to be positioned parallel and adjacent to work piece 60. Next, knob 45 will be rotated in the direction of arrow 47, which will cause threaded rod 40 to pass upwards. This movement brings u-shaped member 30 closer to jaw 24 and farther from jaw 26. In the arrangement of FIG. 3, this will lead to gap 48 increasing, until substantial force exists between pipe 50 and workpiece 60. As long as pipe 50 is somehow anchored relative to workpiece 60, the application of force normal to workpiece 60 may occur at any point along the longitudinal travel of pipe 50. In a yet further preferred combination, pipe 50 will be comprised by a pipe clamp, and any point that can be spanned by such a pipe clamp may also have preferred multi-clamp 10 applied. In fact, the present invention is not limited to the application of only one multi-clamp 10, but a plurality of similar multi-clamps may be applied.

As should also be apparent, the movement of knob 45 in the clockwise direction of arrow 47 may also be used to bring jaws 36 and 24 into engagement with a workpiece there between. Consequently, preferred multi-clamp 10 may be used either to apply expansive forces as shown in FIG. 3 by applying spreading forces between jaw 36 and jaw 26, or preferred multi-clamp 10 may be used to produce compressive forces between jaws 24 and 36.

Threaded rod 40 will most preferably be sufficiently long to permit jaw 36 to move into adjacent contact with jaw 26. By permitting this contact, bar 50 may be almost immediately adjacent to work piece 60 and still be operative in association with preferred multi-clamp 10. The minimal space required, which is only slightly more than the thickness of jaws 26 and 36, enables the present invention to be used in many applications that would otherwise be impossible in the prior art.

A typical bar clamp will include a bar having an elongated shape. The bar may be integrally formed with, or attached, to another type of shape to provide decorative or functional enhancements. These other shapes might include, for exemplary purposes only and without limitation thereto, hinges, clamps, locking devices, protective end covers or shapings, edge-attached strengthening or stiffening methods, or other modifications too numerous to mention herein. Consequently, while pipe 50 has been illustrated, it will be understood that any spanning member which may be accommodated within preferred multi-clamp 10 will be satisfactory.

Figure 4:
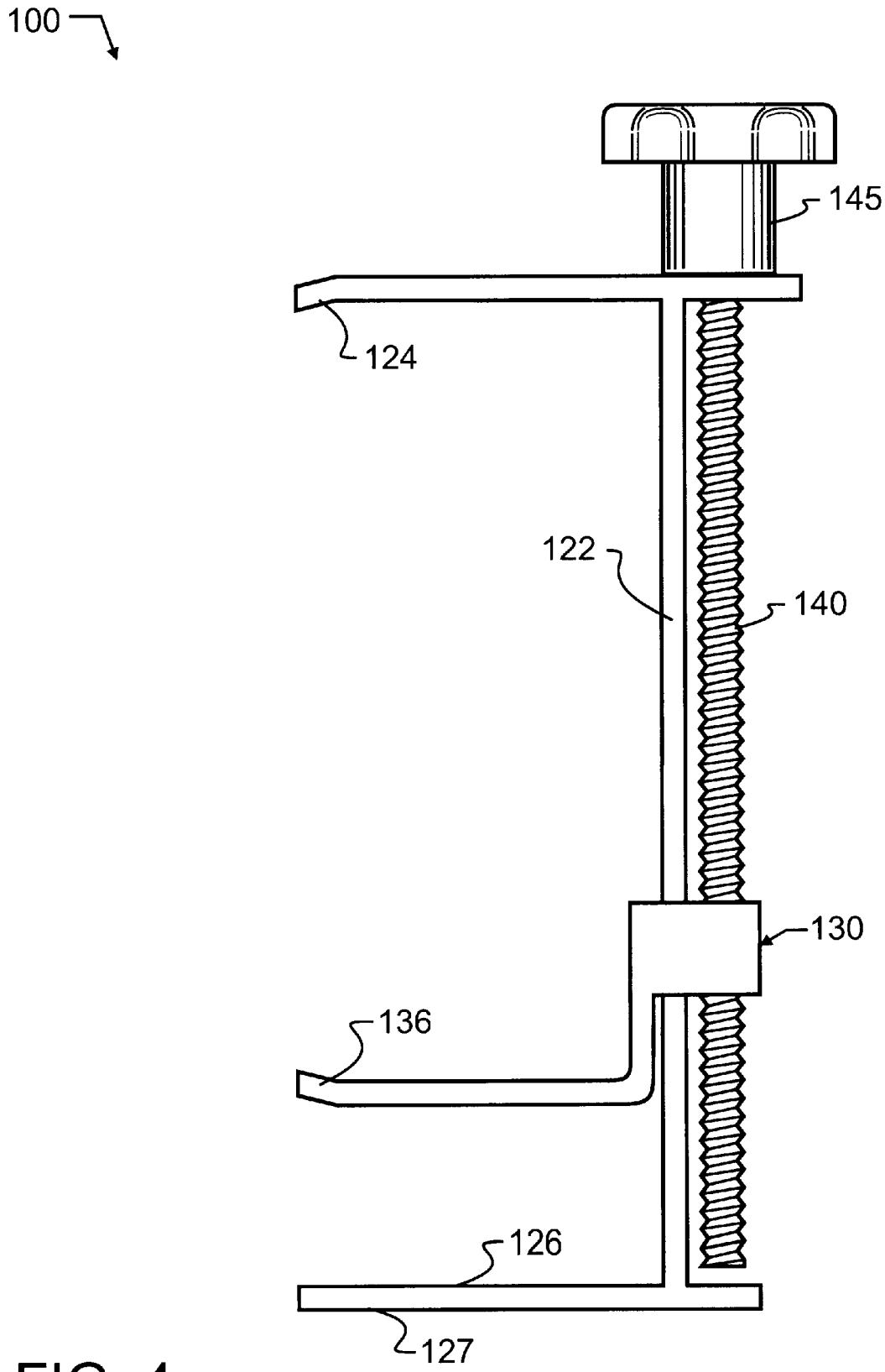
FIG. 4 illustrates a first alternative embodiment multi-clamp designed in accord with the teachings of the present invention from a side plan view.
Figure 5:
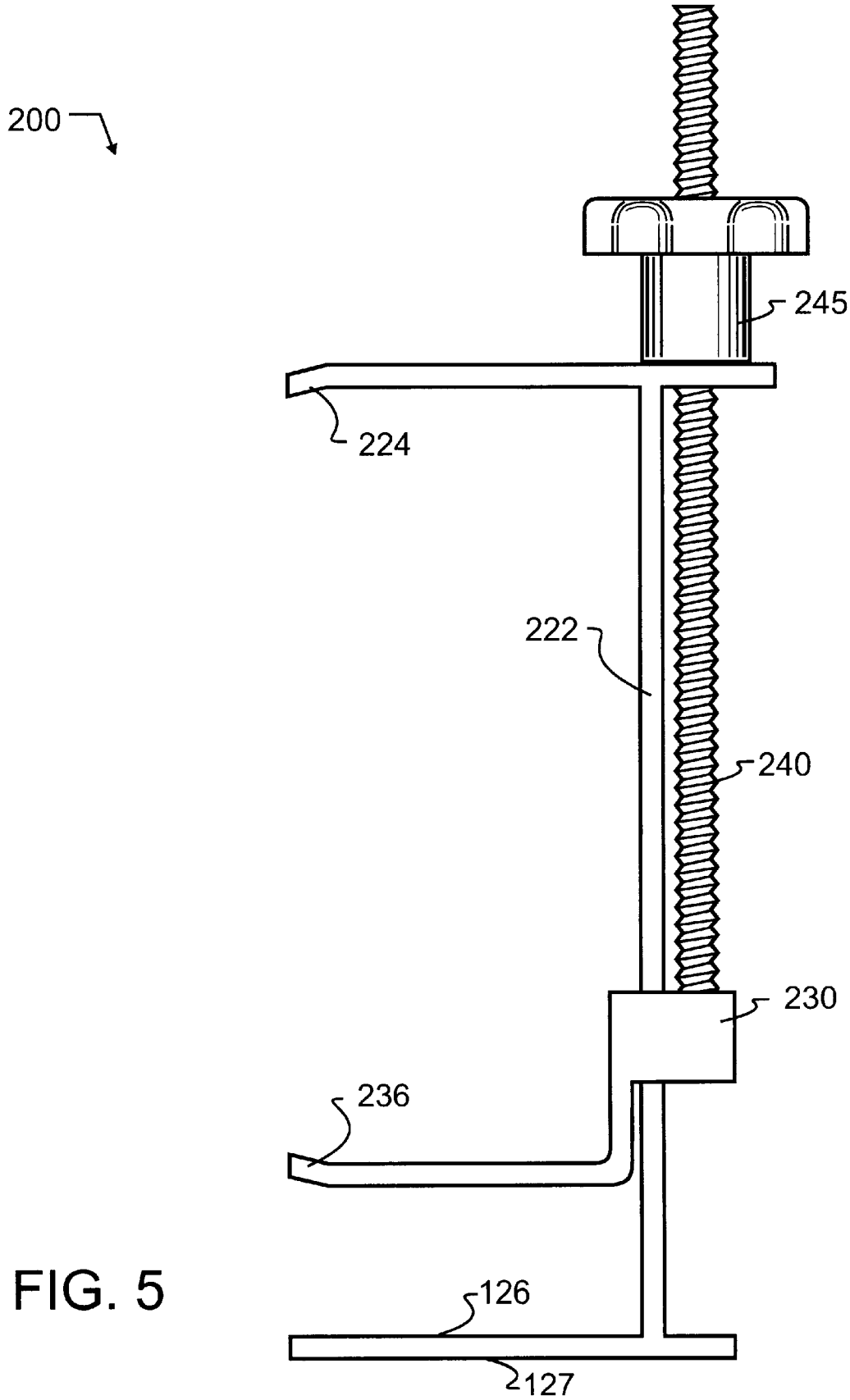
FIG. 5 illustrates a second alternative embodiment multi-clamp designed in accord with the teachings of the present invention from a side plan view.

FIG. 4 illustrates a first alternative embodiment, and FIG. 5 illustrates a second alternative embodiment. The last two digits of numbering have been preserved to designate similar or like components, and consequently the descriptions will not be repeated herein except with regard to notable differences between the embodiments. With regard to first alternative multi-clamp 100 of FIG. 4, knob 145 and threaded rod 140 are rigidly connected. Consequently, when one turns, the other does also. Member 130 will most preferably be threaded or have a nut or other threaded member located about threaded rod 140. Consequently, when knob 145 is rotated, the threads on rod 140 will drive mating threads within member 130 and thereby move member 130. This embodiment permits member 130 to be forcefully driven either direction. Without threading member 23 where threaded rod 40 passes through, preferred multi-clamp 10 will only be driven forcefully in a single direction.

With respect to second alternative embodiment FIG. 5, threaded rod 240 is rigidly affixed to member 230, but moves with respect to knob 245. In this case, rotation of knob 245 leads to movement of both rod 240 and member 230, thereby leading to the movement of jaw 236.

While it may not be immediately apparent, the present invention is operative with only three jaws 24, 26 and 36. Jaw 36 is singly operative with either jaw 24 or jaw 26, which simplifies the construction of the invention, and also permits the illustrated bending in jaw 36 of FIG. 1.

The present invention is not limited solely to one type of stock material or another, nor to one type of operation or another being performed to or with the object. Instead, it will be recognized and understood that the discussions herein are applicable to all types of materials and situations that are otherwise appropriate, as already known in the art of clamping.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims hereinbelow.

I claim:

1. A clamp consisting essentially of:

a first jaw attached to an actuating assembly that car be driven with force along a linear path and having a work engaging surface facing generally in a first direction along said linear path;

a second jaw attached at a first substantially fixed location along said first jaw linear path having a work engaging surface generally facing said first jaw;

a third jaw at a second substantially fixed location alone said first jaw linear path separated from said second jaw by said first jaw and having a work engaging surface generally opposed to said first jaw work engaging surface, said second and third jaws further comprised by a single u-shaped rigid strap; and an actuator coupled to and actuating said first jaw along said linear path forcibly toward said second jaw.

2. The clamp of claim 1 wherein said second jaw and said third jaw bound said first jaw linear travel path.

3. The clamp of claim 1 wherein said actuator further comprises a threaded rod coupled at a first location with said first jaw and coupled at a second location spaced from said first location with a threaded knob.

4. A workpiece and associated support, comprising in combination:

a first major surface upon said workpiece, a support spanning said first major surface; and a clamp having a first channel defining a first wall, a second planar wall generally parallel to said first wall having a first surface facing said first wall and a second surface opposed thereto, and a body separating said first and second walls, and a support engaging member nested between said first and second walls and movable relative to said first channel, and a screw actuator applying a pulling force between said second member and said first channel;

said support engaging member rigidly engaging said support and said first channel rigidly engaging said workpiece, said pulling force active to apply a separating force between said support and said workpiece.

5. The combination workpiece and associated support of claim 4 wherein said support further comprises a second clamp.

6. The combination workpiece and associated support of claim 5 wherein said second clamp further comprises a pipe clamp.

7. The combination workpiece and associated support of claim 4 wherein said workpiece first major surface is generally planar.

8. The combination workpiece and associated support of claim 4 wherein said first channel further comprises formed sheet stock.

9. A clamp, comprising:

a first un-shaped strap having a body member and two legs extending from said body, said legs defining a gap therebetween and a first axis of direction, a coupling and at least one jaw work engaging surface on each of said two legs;

a second u-shaped strap nested within said first u-shaped strap and having a coupling and at least one jaw work engaging surface within said gap, said second u-shaped strap jaw work engaging surface translatable along said first axis between said first unshaped strap two legs; and a means for moving said first u-shaped strap relative to second u-shaped strap.

10. The clamp of claim 9 wherein said moving means is coupled to said first u-shaped strap coupling and to said second u-shaped strap coupling and exerts a force there between to effectuate said moving.

11. The clamp of claim 9 wherein said moving means further comprises a threaded shaft and a rotary actuator coupled to said threaded shaft.

12. A clamp consisting essentially of:

a first member having a body, and having first and second jaws coupled to said body at locations distally from each other;

a second body member nested within said first body member and between said first and second jaws having a third jaw coupled to said second body member;

an actuator engaging said first and second body members to move said second body member relative to said first body member along an axis of travel.

13. The clamp of claim 12 wherein said first member body and first and second jaws further comprise unitary sheet metal.

14. The clamp of claim 12 wherein said second body member further comprises unitary sheet metal.

15. The clamp of claim 12 wherein said actuator further comprises a threaded rod and hand nut.

16. The clamp of claim 15 wherein said threaded rod is coupled rigidly to said second body member and passes freely through said first member, said hand nut actuated to move said second body member forcibly in only one direction along said axis of travel.

* * * * *